455-607 AU 233 EX
10/13/81 XR 4,294,682

United States Patent [19]

Deczky

[11] 4,294,682

[45] Oct. 13, 1981

[54] DATA ACQUISITION SYSTEMS

[75] Inventor: Andrew E. Deczky, Ottawa, Canada

[73] Assignee: Alcan Research and Development Limited, Montreal, Canada

[21] Appl. No.: 764,167

[22] Filed: Jan. 31, 1977

[30] Foreign Application Priority Data

Jan. 29, 1976 [CA] Canada ..... 244504

[51] Int. Cl.[3] ..... H04B 9/00; G06K 15/20

[52] U.S. Cl. ..... 204/244; 364/478; 204/225; 110/185; 340/870.16; 340/870.28; 455/607

[58] Field of Search ..... 358/101, 901; 250/199; 235/151; 340/201 P, 190, 189, 149; 204/DIG. 11, 67, 243, 244, 245, 246, 247, 225; 364/478; 221/9, 129; 365/94; 414/909; 110/185; 455/607, 606

[56] References Cited

U.S. PATENT DOCUMENTS

| | | | |
|---|---|---|---|
| 3,809,908 | 5/1974 | Clanton | 358/901 |
| 3,898,373 | 8/1975 | Walsh | 250/199 |
| 4,008,142 | 2/1977 | Doring et al. | 204/67 |
| 4,039,785 | 8/1977 | Ziemann | 364/478 |

OTHER PUBLICATIONS

P. J. Davies, Optical Communication Link, Jan. 1977, IBM Tech. Discl. Bulletin, vol. 19, No. 8, pp. 2884–2885.

Y. Satake et al., "Recent Trends in Crane Automation Systems for Steel Plants", Mitsubishi Electric Eng., #49, Sep. 1976.

J. G. Lackey et al., "An Optical Telemetry Technique Using a Remote Modulator and Digital Read-Out", 6–70.

*Primary Examiner*—Marc E. Bookbinder
*Assistant Examiner*—Edward L. Coles
*Attorney, Agent, or Firm*—Cooper, Dunham, Clark, Griffin & Moran

[57] ABSTRACT

A data acquisition system for a hot metal handling operation uses optical transmission of data from a plurality of hot-metal stations to a control computer. Preferably the computer transmits control instructions to operators via the optical link. In an aluminium pot-line arrangement the mobile transceiver may be mounted on the service crane.

14 Claims, 5 Drawing Figures

FIG. 1
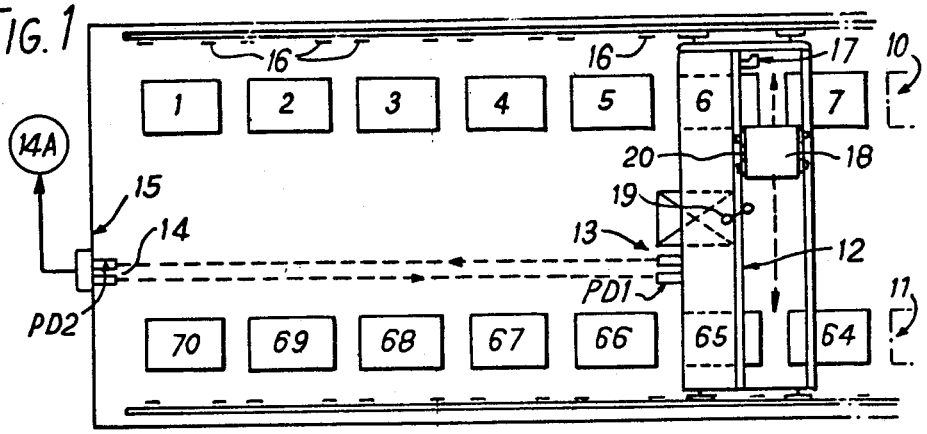
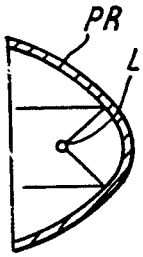
FIG. 2
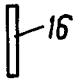
FIG. 3
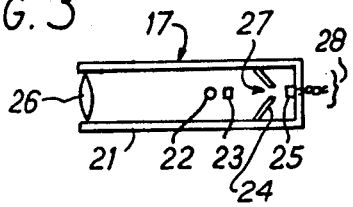
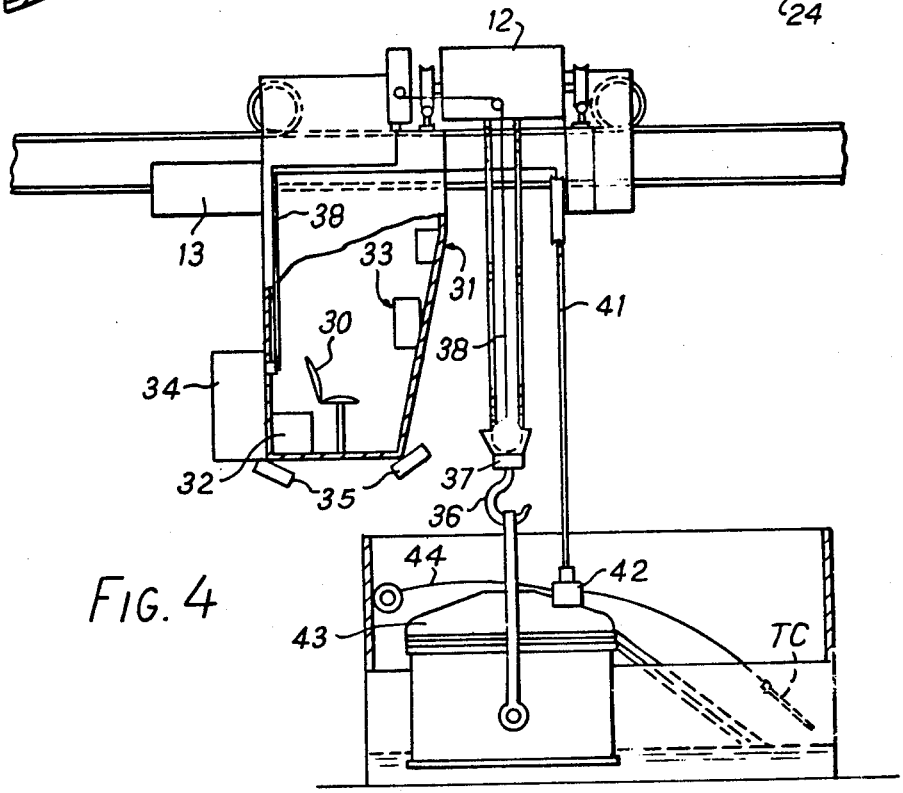
FIG. 4

Obviously the efficiency of any system is improved as the accuracy of the input data is improved. Weighing systems currently in use are obsolete and errors up to about 200 lbs are quite common. One way to obtain more accurate weight readings is to utilize a highly accurate strain gauge load cell in the crane hook. Furthermore, use can be made of stabilized excitation voltage, a common-mode rejecting integrating digital voltmeter and proper signal conditioning. These measures will improve accuracy and in particular will help overcome the obvious dynamic errors caused by the load oscillations. This strain gauge cell produces a voltage signal related to the weight lifted by the hook and this signal can readily be translated to a digital signal for transmission over the optical link to the computer.

Thus, in accordance with the invention, there is provided, in a hot metal handling operation comprising a plurality of operating stations wherein a crane services each operating station by adding raw materials and removing molten metal, a data acquisition system comprising means associated with the crane for measuring process variables at each operating station and means on the crane for optically transmitting information concerning the measurements to a computer located remotely of said operating stations.

BRIEF DESCRIPTION OF THE DRAWINGS

The invention will now be further described in conjunction with the accompanying drawings, in which:

FIG. 1 is a simplified diagram of a pot room having two rows of aluminium reduction pots, and employing a data acquisition system in accordance with the invention;

FIG. 2 is a schematic view of the optical system of the data transceiver of the FIG. 1 embodiment;

FIG. 3 is an illustration of the optical system for use in transmitting data or determining crane position;

FIG. 4 is a simplified elevational view of the overhead crane and an aluminium reduction pot of FIG. 1.

DESCRIPTION OF THE PREFERRED EMBODIMENTS

Figure 5:
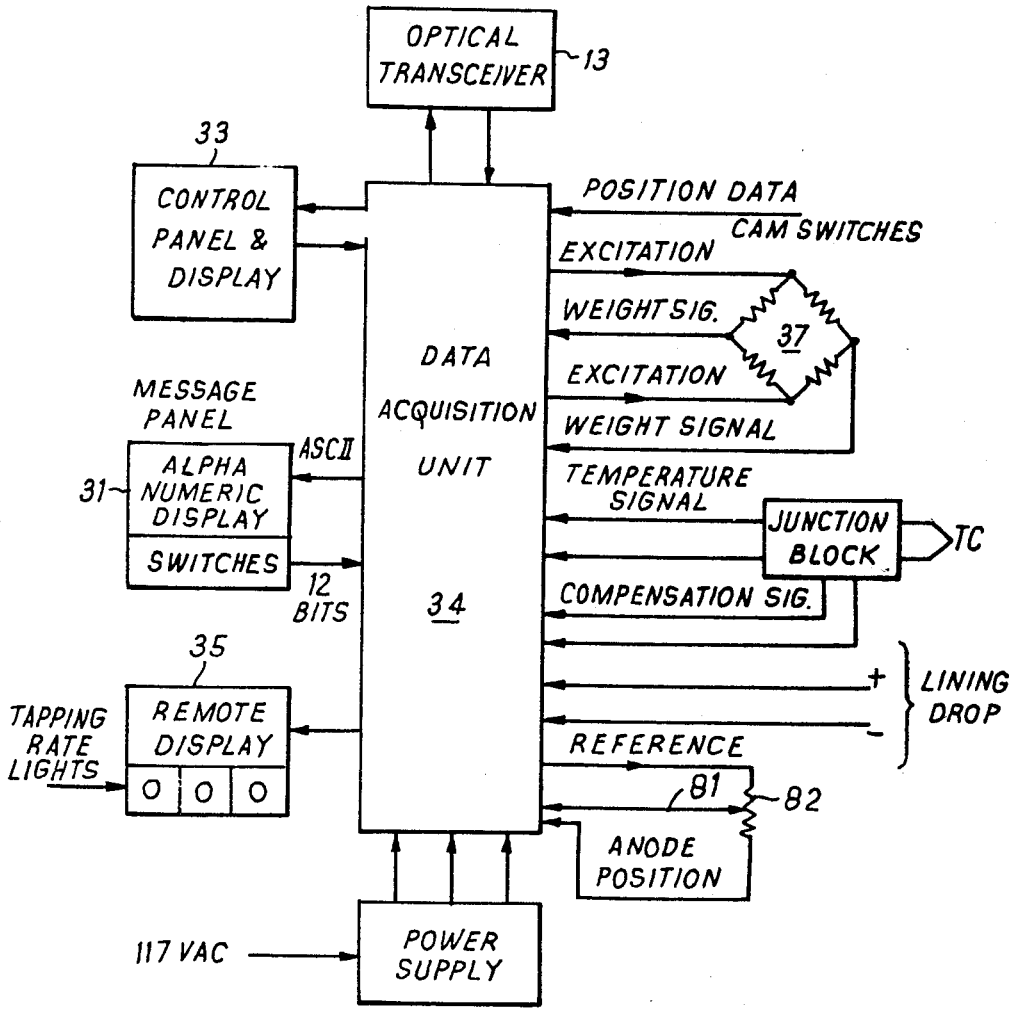
FIG. 5 is a block diagram of the crane-mounted subsystem of the embodiment of FIG. 1.

FIG. 1 is a simplified diagram of a pot room having two rows of electrolytic aluminium reduction cells (pots) generally indicated at 10 and 11. An overhead crane, generally indicated at 12, travels back and forth along the two rows of pots in order to service them, for example, to add alumina, remove molten aluminium, and to add paste, if a Soderberg-type anode is used.

Attached to the crane 12 is an optical transmitter-receiver called transceiver 13 in optical communication with a stationary transceiver 14 secured to an end wall 15 of the pot room. The stationary transceiver 14 is in communication with a computer, not shown, via a cable 14A.

The optical transceivers could use lasers but preferably each use a directly modulated light emitting diode (LED) mounted at the focal point of a parabolic reflector 6 to 8 inches in diameter. The beam divergence angle of the optical telemetry unit is preferably adjusted to a total of 1°, i.e. $\pm\frac{1}{2}°$ either side of the optical axis. A fresnel reflector may be used rather than a parabolic reflector, if desired. FIG. 2 illustrates the parabolic reflector arrangement, the light-emitting diode LED being shown at the focal point of the parabolic reflector PR. The transmitter part of the transceiver 14 is identical.

In order that the computer knows which pot in a row of pots is being serviced some method of pot identification must be employed. One particularly simple method is to mount an emitter-receiver photoelectric sensor 17 on the crane and place optical reflectors 16 in a suitable code (e.g. binary numbers in the vertical plane), along the side wall behind each pot. Light emitted from the sensor will be reflected by the reflectors in the code which identifies the pot.

FIG. 3 illustrates in more detail a preferred photoelectric means for sensing the position of the crane. Each emitter-receiver photoelectric sensor 17 comprises a tubular housing 21 in which is contained a light source 22, a light shield 23, a parabolic reflector 24, a lens 26 and a photodetector 25. Light emitted by the light source 22 is blocked by shield 23 from directly reaching photodetector 25 but is reflected by fresnel reflector 24 towards the reflector 16. If desired, reflector 24 could be a parabolic reflector rather than a fresnel reflector. Light reflected from 16 is directed by lens 26 through the central aperture 27 of parabolic reflector 24 onto photodetector 25. A signal is derived from photodetector 25 via leads 28.

The rolling crane 12 serves two rows of pots, 10 and 11. In order to accomplish this, the hook trolley 18 has to cross the centre line between the two rows of pots 10 and 11. A limit switch 19 is attached to the crane bridge and is activated bidirectionally by a cam 20 located on trolley 18. The system recognizes the position of the trolley and interprets the binary numbers according to which row is serviced.

FIG. 4 is an elevational view and shows, in simplified form, the overhead crane and an aluminium reduction cell (pot). The crane cab 30 is provided with a display 31 to receive data from the computer and console switch system to transmit messages to the computer.

A control panel 33 contains all necessary display lights and switches to operate the crane data system. Item 34 is the DAU (Data Acquisition Unit) containing all electronic components for measuring, controlling, multiplexing, transmitting and receiving data to and from the computer. Two independent measuring units assure continuous weight monitoring and enable the computer to measure other parameters simultaneously. Furthermore the second unit provides a necessary electrical isolation from the pot potentials. A power supply system 32 provides the required isolated and stabilized dc power for the entire system. Two remote displays 35 are for use by a floor operator. An optical transceiver 13 communicates with the computer. The receiver part of the transceiver 13 includes a photo-diode PD1, and the receiver part of the transceiver 14 includes a photo-diode PD2.

The hook 36 of the crane 12 is provided with a load cell 37, comprising a strain gauge type of compression load cell, which, when the crane operator lifts the crucible, provides weight measurements over line 38 to the DAU 34 and, via the optical link, the computer.

Molten metal is removed from the pots by a syphon ladle having a syphon dome 43. The ladle is carried by the crane to a position where the syphon tube projects over one wall of the pot into the molten metal. The syphon tube therefore assumes the potential of the molten metal when emersed therein. A syphon control terminal 42 is located on the syphon dome 43. A multicore retractable cable 41 is manually plugged into the

DATA ACQUISITION SYSTEMS

BACKGROUND OF THE INVENTION

This invention relates to a data acquisition system in a hot metal handling operation, and in particular, to a system for use with electrolytic aluminium reduction pots.

In the past, the aluminium smelting industry operated their plants almost entirely manually and the operation was more an art than a science and plant efficiency depended mainly on the skill and experience of the operating personnel.

During the last two decades or so, various efforts have been made to make a transition from art toward science in the control of pot operation. The main problem has been the complete lack of suitable control systems, and the lack of knowledge to develop complex controls.

During the last ten years, predominantly electrical resistance control of pot operation has been introduced almost throughout the aluminium industry. This system requires the simultaneous measurement of individual pot potentials and line current. These parameters have been used to compute the individual pot resistances and compare them to an assigned target and to raise or lower the anodes automatically, so as to keep the pot resistances at an individual predetermined value.

Almost all such systems employ a computer to operate on acquired data to effect associated control functions. The computer, however, is used as a blind executive element or a simple calculating machine without any judgment, and it will follow the target pot resistance set by the operator, whether or not that is the resistance at which the pot operates most efficiently.

Essential information was missing to enable the decision-making ability of the computer to control the individual pots and to obtain highest efficiency in lines which, it should be noted, comprise two rows of pots each containing up to about 240 series-connected pots in individual pot rooms that can be as long as 4000 feet.

It was recognized that these pots frequently operate below normal efficiencies for prolonged periods of time.

It is obvious that if the individual performance of the pots can be monitored by the computer, the operation of the inefficient pots can be adjusted in proper time and, if adequate information is at hand, the necessary programs can be provided to restore them to high operating efficiency.

It has been recognized that previous technology for controlling smelters did not provide a sufficiently broad spectrum of information to achieve such individual efficiency control.

Such control entails the accurate measurement of certain pot parameters such as the inflow and outflow of materials; heat conditions; changes in electrolyte freeze contour configurations; variations in cathode resistance; and rate of specific carbon consumption. It is also required that instructions are generated, transmitted and effected so as to maintain each individual pot as close to optimum operation as possible through, for instance, timely additions of alumina to the electrolyte, timely removal of the optimum amount of metal and appropriate positioning of the anode of each pot with respect to the cathode.

It would be impractical to feed the computer with information about such parameters by a conventional system using wire connections since the cost would be prohibitive and its maintenance very difficult.

In each pot room there usually exists an overhead crane moving on rails over the pots. This crane is used to service the pots.

SUMMARY OF THE INVENTION

In the present invention this crane is provided with a mobile data acquisition system which, during servicing of the pots, gathers the necessary information about pot parameters such as those specified above. This data has then to be transmitted to the computer. Because there is a great deal of electrical interference in the vicinity of the pots, it is very difficult to transmit such data from the crane using induction or radio or v.h.f. methods. Thus in the present invention, communication is effected via a two-way optical link using, preferably, infrared radiation which may be provided by a light emitting diode (LED) or laser.

The present invention thus proposes a crane located data acquisition system which, with a highly efficient optical link to the computer, enables the computer to be programmed and instructed so as to optimize the smelting process by monitoring and controlling operation of each individual pot, and minimizing the need for operator control.

This invention relates to a mobile computer-associated data acquisition and weight control system, for metal smelting operation and in particular for use with electrolytic aluminium reduction cells or pots.

The invention goes beyond the scope of conventional pot resistance control associated with a computer or other hardware system. The principal short-coming of the conventional systems is the lack of process optimization. The absence of accurate material weighing and control, bath temperature, freeze contour, anode height, and cathode resistance measurement and its use prevents an efficient operation. The use of an efficient computer input console at the site to report conditions to the computer enables the logic to react properly.

The present invention overcomes the difficulties outlined above by a combination of simple expedients. First of all, the invention takes advantage of the fact that the pots are serviced by an overhead crane. Normally this travels on rails, moves along between two rows of pots and, by swinging from one side to the other, services both rows of pots. The invention utilizes a crane-mounted data acquisition unit (DAU) to measure, control and/or effect various process variables such as weight of material added to or taken from a pot, metal temperature, anode and cathode voltage, etc.

When using the crane-mounted DAU, it is necessary to be able to transmit data from the crane to a remote location for utilization, e.g. by a computer, and to transmit commands from the computer to the crane unit. In accordance with the present invention, this is done by transmitting the information optically, preferably over an infrared beam. Thus the crane can be provided with an optical transceiver, for example a serial frequency shift modulation type, in communication with a stationary transceiver mounted on a wall of the pot room. This stationary transceiver can be connected by cable to a computer. Thus there is no problem concerning a multiplicity of lengthy cables from the pots to a remote location and the optical transmission system can function in the dirty and electrically noisy environment of a pot room.

terminal 42. The control terminal 42 is further connected manually, when the ladle arrives at the pot, to an extension cable 44. Cable 44 passes through a rubberised plug and has four wires connected to respective poles at the pot receptacle. Another wire which is plugged into the terminal 42 when the ladle is in position is connected to a thermocouple TC for giving an output according to pot temperature. Thus, cable 41 connects the thermocouple and compensation wires, the syphon solenoid control wires, the syphon tube and the four pot receptacle poles. The potential difference between the syphon tube when inserted into metal and the cathode busbar defines the cathode voltage drop which, divided by the potline current, measures the cathode resistance, an important parameter that has to be monitored during the operation of the pot line.

The system according to the invention first can acquire various data from the pot via the crane data acquisition unit, transmit that data to the pot room wall via a two-way optical telemetry link and provide a data interface to the process control computer system and second can provide feedback and communication to the crane cab on the status and control of the reduction process and where desirable provide signals to alter pot parameters e.g. to actuate the motors which control the position of the anode in the pot. Since the crane travels in a straight line, optical telemetry offers a simple method to solve the severe problems associated with communicating between it and the computer. The first of these problems is, of course, the fact that the crane moves substantial distances since the length of a pot line is at least 800 feet and can be as much as 4000 feet. An automatic gain control is provided to eliminate signal saturation and fading due to great distance range and possible crane wobbling. Secondly, severe electrical and environmental difficulties must be overcome. Optical telemetry can meet these challenges quite effectively.

There are three major elements in the telemetry system. The first element is the crane sub-system which contains an optical transceiver 13, a data acquisition unit 34, a control panel 33, remote display 35 and a message panel 31, as shown in FIG. 5. The crane mounted optical transceiver 13 both transmits an optical data stream to a stationary optical receiver and receives an optical data stream from the stationary optical transmitter. The Data Acquisition Unit (DAU) 34 controls and digitizes the various analog measurements indicated which are made from the crane in response to commands from the computer, the operator or an automatic sequence. The control panel 33 contains displays to allow the crane operator to observe the status of the operations of the system and controls for the crane operator to enter operations he desires the system to perform. The message panel 31 contains an alphanumeric display under computer control to provide information to the crane operator and also a bank of switches which the operator may use to send information to the computer. Provided also is a remote display 35 on the crane which displays net weight and rate of metal flow to production workers on the pot room floor.

The second element in the system is the stationary optical transceiver sub-system. The purpose of this stationary transceiver is to convert the optical data stream from the crane to an electric data stream which is transmitted to the controller for decoding. The stationary transceiver also transmits the encoded data to the crane from the controller.

The final element is the communication controller. Its function is to convert the serial encoded data stream from the stationary transceiver into necessary process interrupts and data words for the computer, and to take instructions from the computer to encode them into serial format for transmission to the crane.

In a particular embodiment of this invention the overhead crane in an aluminium reduction pot line was used with an infrared beam as the optical link. The Data Acquisition Unit was a computer independent device, which could be interrogated or instructed by the computer as a peripheral. The timing and the coordination of the multipurpose data system was entirely under the control of the DAU. However, the computer was obliged to interrogate the DAU for data transmission whenever the operator started an operation or the computer software program called for it. The crane mounted system had selectable function modes such as: metal tapping, skimming the molten metal (skimming), alumina weighing, paste weighing, anode height position, cathode potential, bath temperature, and message transmission to computer. By selecting one of the three control modes (i.e. computer, automatic, manual) the weight target limit for the metal was either computer set, operator preset or operator controlled. In all three cases the syphon vacuum used to suck the metal into the ladle from the pot was started when the operator energized the syphon control solenoid valve (not shown). During the metal tapping by syphon, suitable computer sub-routines were executing several functions as listed:

a. Monitoring the metal flow rate and activating three coloured signal lights located outside the crane cab on remote display 35, to aid the floor operator to adjust the required metal flow rate. It is extremely important to avoid excessively high (sludge pick up) and low (freezing of the syphon) flow rates.
b. When the operator started the metal tapping cycle, the computer first measured the pot resistance of the given pot via a wired resistance measuring system not pertaining to the optical telemetry system. The metal flow started only when the computer had accomplished the measurement. After a tolerable quantity of metal had been syphoned from the pot without necessitating a lowering of the anode, a second measurement was made of the pot resistance. The weight/resistance-difference ratio is directly related to the area of the liquid cavity and hence to the freeze contour of the pot in question. Thus, the extent of the freeze contour may be computed according to a built-in model in the computer.
c. After the foregoing phase "b" the anode position was measured via the DAU and a go-ahead signal was given to the resistance control system to lower the anode to its target position.
d. After phase "c" the bath temperature was measured via the telemetry and DAU.

Skim I and Skim II weight measurements were executed before and after the skim removal. The two selectable skims are for differentiating between a high purity crucible and a relatively low purity crucible.

The Alumina mode measurements required that the operator used the start signal when he began to distribute the ore to several pots and used the stop signal when the last discharge was completed. The in-between pots fractions were measured by the system automatically, without any cooperation from the operator. The measuring and transmitting signals were generated when the crane rolled over to the next pot and by doing so activated the next binary coded pot position signal.

A further advantage of this invention is that, because the anode position of each pot is easily measured and the measurements given to the computer, the computer can easily determine the optimum amount of paste to be added to each anode, in the case of Soderberg anodes.

While the foregoing system has been described with particular reference to an aluminium smelting operation it will be obvious that it can also be used in any hot metal handling operation comprising a plurality of operating stations wherein a crane services each station by adding raw materials and removing molten metal. For example the system could readily be adapted for use in the copper and steel industries and with alloying furnaces. Similarities in operations and problems render the system of this invention suitable for use in other operations such as these.

I claim:

1. A system for a hot metal handling operation comprising:

a plurality of operating stations each including an electrolytic aluminum reducing pot;

a mobile crane for servicing said pots at each operating station by adding raw materials and removing molten metal;

a data acquisition system comprising:

means associated with the crane for providing identification information of a particular pot and pot row being serviced;

means associated with the crane for measuring process variables at each operating station; and means on the crane for optically transmitting said identification information and said information concerning the measurements over a cableless path from said crane to a receiver and computer located remotely of said operating stations.

2. A system as claimed in claim 1 wherein said crane is an overhead crane movable along between rows of pots and the means for providing identification of a particular pot being serviced comprises co-axial light sources and photocells mounted on the crane which cooperate with reflectors mounted in coded patterns on the pot room wall, a switch being operated by the crane when it moves from one row of pots to another to identify which row of pots the particular pot is located in.

3. A system as claimed in claim 1 wherein said means for optically transmitting information operates in the infra-red region of the spectrum.

4. A system as claimed in claim 1 wherein each operating station comprises an alloying furnace.

5. A system as claimed in claim 1 wherein said means on said crane for optically transmitting information and identification comprises an optical transceiver having, as a transmitting element, a light emitting diode or laser and, as a receiving element, a photosensitive detector.

6. A system as claimed in claim 5 wherein said photosensitive detector is a photodiode.

7. A system as claimed in claim 6 wherein said light emitting diode is mounted at the focal point of a parabolic reflector.

8. A system as claimed in claim 5 wherein said optical transceiver is in optical communication with said receiver which comprises a further optical transceiver mounted on a wall of a pot room containing said pots and each of said optical transceivers has, as a transmitting element, a light emitting diode and, as a receiving element, a photodetector.

9. A system as claimed in claim 8 wherein said crane is a mobile crane movable in a straight path along at least one row of pots and said optical transceivers are aligned along said path.

10. A system as claimed in claim 8 wherein said crane includes a data acquisition unit for converting measurements of process variables in analog form into digital signals for transmission by the optical transceiver on said crane to the optical transceiver mounted on the wall of the pot room.

11. A system as claimed in claim 10 wherein the crane is provided with a lifting hook having a strain gauge weight measurement cell whereby the data acquisition unit can obtain information, for transmission to the computer, regarding the weights of materials supplied to or removed from a pot.

12. A system as claimed in claim 10 including a thermocouple connectable between the crane and a pot whereby the temperature of metal in the pot may be transmitted to the crane and thence, via the optical transceivers, to the computer.

13. A system as claimed in claim 8 wherein the computer can send information to the crane via the two transceivers, which transceivers comprise an optical link, and the crane has a message display panel.

14. A system as claimed in claim 13 wherein the message panel includes an alphanumeric display under computer control to provide information to an operator of the crane and a plurality of switches which the crane operator may use to send information to the computer.

* * * * *